US007827800B2

(12) United States Patent
Stastny et al.

(10) Patent No.: US 7,827,800 B2
(45) Date of Patent: Nov. 9, 2010

(54) COMBUSTOR HEAT SHIELD

(75) Inventors: Honza Stastny, Georgetown (CA); Parthasarathy Sampath, Mississauga (CA); Carol Desjardins, Carignan (CA); Kenneth Parkman, Georgetown (CA); John Greer, Oakville (CA); Stephen Phillips, Etobicoke (CA); Eduardo Hawie, Woodbridge (CA); Yvan Schraenen, Mt. Saint Hilaire (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 966 days.

(21) Appl. No.: 11/551,021

(22) Filed: Oct. 19, 2006

(65) Prior Publication Data

US 2008/0092546 A1 Apr. 24, 2008

(51) Int. Cl.
*F02C 1/00* (2006.01)

(52) U.S. Cl. ..... 60/752; 60/755; 60/39.11

(58) Field of Classification Search ..... 60/39.11, 60/722, 752, 755, 756, 757, 748
See application file for complete search history.

(56) References Cited

U.S. PATENT DOCUMENTS

| | | | | |
|---|---|---|---|---|
| 2,669,090 | A | 2/1954 | Jackson | |
| 3,169,367 | A | 2/1965 | Hussey | |
| 3,608,309 | A | 9/1971 | Hill et al. | |
| 4,226,088 | A | 10/1980 | Tsukahara et al. | |
| 4,246,757 | A | 1/1981 | Heberling | |
| 4,322,945 | A * | 4/1982 | Peterson et al. | 60/800 |
| 4,365,470 | A * | 12/1982 | Matthews et al. | 60/800 |
| 4,475,344 | A | 10/1984 | Mumford et al. | |
| 4,590,769 | A | 5/1986 | Lohmann et al. | |
| 4,702,073 | A | 10/1987 | Melconian | |
| 4,914,918 | A * | 4/1990 | Sullivan | 60/756 |
| 5,129,231 | A | 7/1992 | Becker et al. | |
| 5,165,226 | A | 11/1992 | Newton et al. | |
| 5,307,637 | A | 5/1994 | Stickles et al. | |
| 5,398,509 | A | 3/1995 | North et al. | |
| 5,590,531 | A | 1/1997 | Desaulty et al. | |
| 5,894,732 | A * | 4/1999 | Kwan | 60/756 |
| 5,956,955 | A | 9/1999 | Schmid | |
| 6,427,446 | B1 | 8/2002 | Kraft et al. | |
| 7,140,189 | B2 * | 11/2006 | Markarian et al. | 60/796 |
| 7,478,534 | B2 * | 1/2009 | Guezengar et al. | 60/796 |
| 2003/0213249 | A1 | 11/2003 | Pacheco-Tougas et al. | |
| 2008/0104962 | A1 * | 5/2008 | Patel et al. | 60/752 |

* cited by examiner

*Primary Examiner*—Michael Cuff
*Assistant Examiner*—Young Choi
(74) *Attorney, Agent, or Firm*—Ogilvy Renault LLP

(57) ABSTRACT

A combustor heat shield comprises a heat shield member defining at least one opening for receiving a fuel nozzle. A louver is received in the opening. The louver has a flow diverting portion extending radially outwardly from the opening for directing air along the hot side of the heat shield member.

11 Claims, 7 Drawing Sheets

COMBUSTOR HEAT SHIELD

FIELD OF THE INVENTION

The present invention relates to gas turbine engine combustors and, more particularly, to a combustor heat shield.

BACKGROUND OF THE ART

Gas turbine combustors are the subject of continual improvement, to provide better cooling, better mixing, better fuel efficiency, better performance, etc. at a lower cost. For example, heat shields are known to provide better protection to the combustor, but heat shields also require cooling.

The cold side of the heat shield can be cooled by impingement cooling provided through holes in the combustor shell. The cooling of the hot side of the heat shield is more challenging in that the cooling air has to be brought to the hot side of the heat shield, i.e. the side that faces away from the combustor shell. In previous heat shield designs, the cooling air for the hot side was provided by relatively expensive multi-part floating collars, or by complex machined devices.

SUMMARY OF THE INVENTION

It is therefore an aim of the present invention to simplify the cooling of the hot side of a combustor heat shield.

It is a further aim of the present invention to provide a relatively low cost combustor heat shield.

Therefore, in accordance with a general aspect of the present invention, there is provided a gas turbine engine combustor comprising a shell enclosing a combustion chamber, a heat shield mounted inside the combustion chamber and spaced-apart from the shell to define an air gap between the heat shield and the shell, the heat shield and the shell each having at least one opening defined therein and cooperating to respectively receive a fuel nozzle, a cooling louver positioned in the opening of the heat shield and having a flow diverting portion extending radially outwardly from the opening of the heat shield on a hot side thereof, the flow diverting portion directing cooling air from said air gap along the hot side of the heat shield In accordance with another general aspect of the present invention, there is provided a heat shield assembly for a gas turbine engine combustor, comprising a heat shield member defining at least one opening for receiving a fuel nozzle, a louver at least partly received in said opening, said louver having a flow diverting portion extending radially outwardly of said opening on a hot side of said heat shield member, and at least one cooling hole for allowing cooling air to flow from a cold side of the heat shield member to the hot side thereof, said at least one cooling hole having an axis intersecting said flow diverting portion of said louver.

In accordance with a further general aspect of the present invention, there is provided a method for manufacturing a combustor heat shield assembly comprising: casting a heat shield having at least one opening for receiving a fuel nozzle, the at least one opening extending thicknesswise through the heat shield between opposed hot and cold sides of the heat shield, and mounting a sheet metal louver to the cast heat shield, the sheet metal louver having a first end portion projecting axially outwardly from said hot side, said first end portion being formed with a flow diverting portion substantially parallel to said hot side.

BRIEF DESCRIPTION OF THE DRAWINGS

Reference is now made to the accompanying figures depicting aspects of the present invention, in which.

DESCRIPTION OF THE PREFERRED EMBODIMENTS

Figure 1:
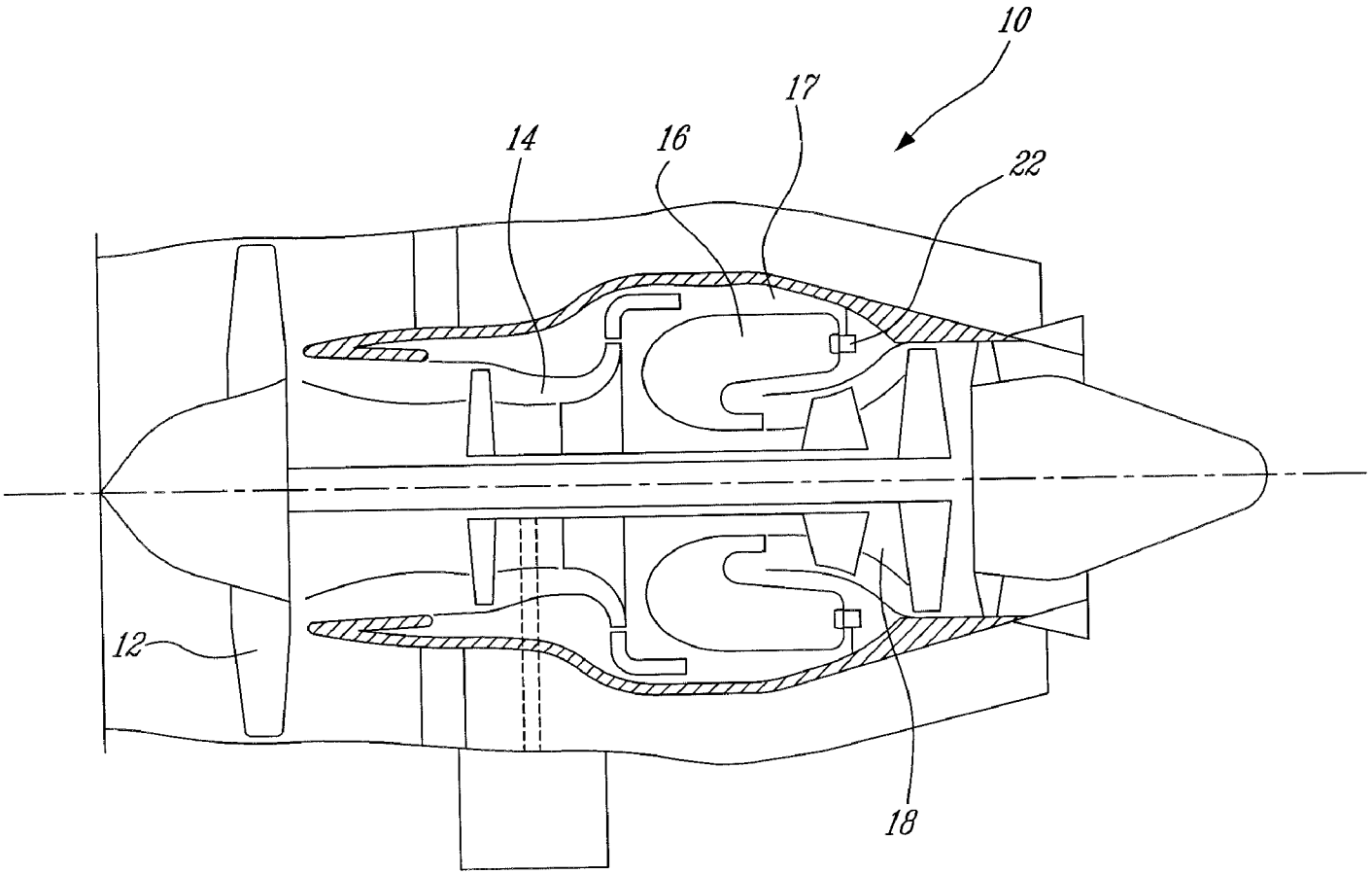
FIG. 1 is a schematic cross-sectional view of a gas turbine engine having an annular combustor.

FIG. 1 illustrates a gas turbine engine 10 generally comprising in serial flow communication a fan 12 (not provided with all types of engine) through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
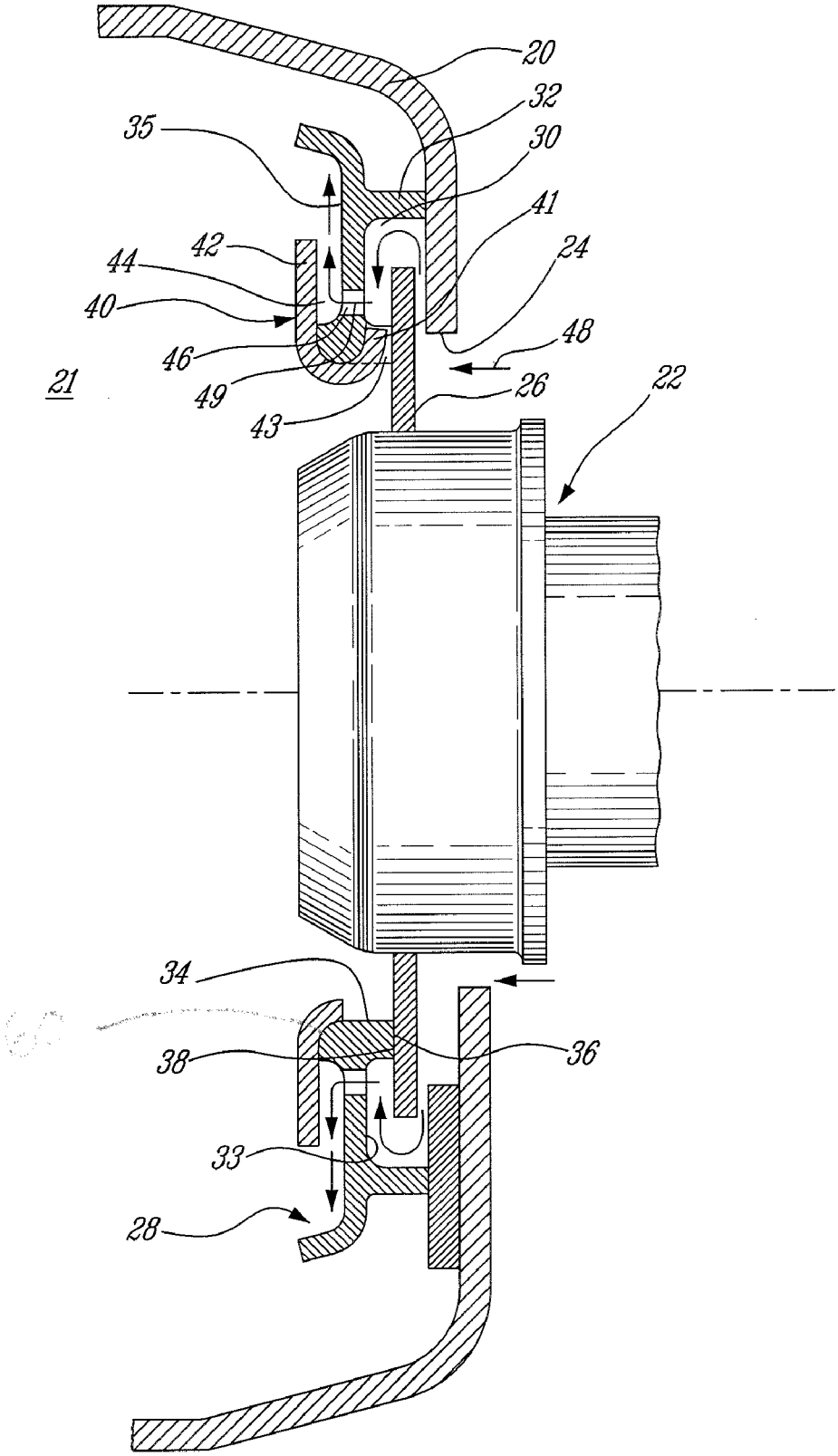
FIG. 2 is an enlarged cross-sectional view of a dome portion of the combustor, the combustor shell being protected against excessive heat by a heat shield having a louver for directing a film of cooling air on a hot surface of the heat shield.

The combustor 16 is housed in a plenum 17 supplied with compressed air from compressor 14. As shown in FIG. 2, the combustor 16 typically comprises a combustion shell 20 defining a combustion chamber 21 and a plurality of fuel nozzles (only one being shown at 22), which are typically equally spaced about the circumference of the combustion chamber 21 in order to permit a substantially uniform temperature distribution in the combustion chamber 21 to be maintained. The combustion shell 20 is typically made out from sheet metal. In use, fuel provided by a fuel manifold (not shown) is atomized by the fuel nozzles into the combustion chamber 21 for ignition therein, and the expanding gases caused by the fuel ignition drive the turbine 18 in a manner well known in the art.

As shown in FIG. 2, each fuel nozzle 22 is received in an opening 24 defined in a dome portion of the combustor 16. A floating collar 26 is mounted in the opening 24 between the combustor shell 20 and the fuel nozzle 22. The floating collar 26 provides sealing with the fuel nozzle 22. In the axial direction, the floating collar 26 is trapped between the combustor shell 20 and a heat shield 28. The heat shield 28 is mounted to an inner surface of the combustor shell 20 and has a surface that extends at a distance therefrom to define an air gap 30. In the illustrated example, the heat shield 28 is attached to the combustor shell 20 by means of an annular stud-like projection 32 extending at right angles from a cold or upstream surface 33 of the heat shield 28. The stud-like projection 32 and the heat shield 28 are integral to one another and made from a high temperature resistant casting material. The stud protrudes through a hole in the shell 20 and is secured by a washer and a self-locking nut. Other fastening means could be used as well. An opening 34 is provided in the heat shield 28 for receiving the fuel nozzle 22. The heat shield 28 is provided on the cold or upstream side thereof with an annular flat sealing surface 36 which extends about the opening 34 for cooperating with a corresponding flat surface 38 on the front face of the floating collar 26. In operation, compressed air supplied from the engine compressor 14 into the plenum 17 in which the combustor 16 is mounted urges the flat surface 38 of the floating collar 26 against the flat surface 36 of the heat shield 28, thereby providing a seal at the interface between the heat shield 28 and the floating collar 26.

An annular louver 40 is mounted in the opening 34. The louver 40 is preferably made of sheet metal and removably attached to the heat shield 28 by flaring (i.e. bending). The louver 40 has a plurality of bendable tabs (only one being show at 41) adapted to be flared onto the heat shield 28 in slots 43 which are cast within the heat shield 28. The louver 40 has an annular portion 42 which extends outwardly of the opening 34 generally in parallel to and downstream of the hot surface 35 of the heat shield 28. Portion 42 is spaced from the hot surface 35 of the heat shield 28 so as to define a plenum 44 therebetween. The desired axial space is defined by spacer 60, which is integrally cast with the heat shield 28. The axial space is calculated for optimum cooling of louver 40 by air exiting it from holes 46. A plurality of cooling holes 46 are defined through the heat shield 28 about opening 34 for allowing cooling air to flow from the air gap 30 into the plenum 44 between the louver 40 and the heat shield 28. The louver 40 directs the cooling air flowing through the cooling holes 46 along the hot surface 35. The air deflected by the louver 40 forms a cooling air film on the hot or downstream surface 35 of the heat shield 28. This provides a simple and economical way to increase the heat shield cooling effectiveness. The louver 40 is made of a low cost material and is easy to install and remove from the heat shield 28. It does not require any complex machining operation. The fact that the louver 40 is independent from the fuel nozzle 22 is also advantageous in that it is not affected by the movement of the nozzle 22 due to thermals and as such it provides for a steady and stable hot side film cooling source.

In use, cooling air flows from plenum 17 into air gap 30 as shown by arrow 48. The air directed into the air gap 30 cools down the cold surface 33 of the heat shield 28. The cooling air flows out from the air gap 30 through cooling holes 46, as shown by arrow 49. The louver 40 directs the air flowing out of the cooling holes 46 on the hot surface 35 of the heat shield 28 to provide hot side film cooling. If the louver 40 is damaged over time due to repeated exposure to high temperatures, it can be readily removed from the heat shield 28 and replaced by another similar louver. Re-installation of louver 40 is aided by the predefined spacer 60. The louver 40 is detached from the heat shield 28 by unfolding the tabs 41.

Figure 3:
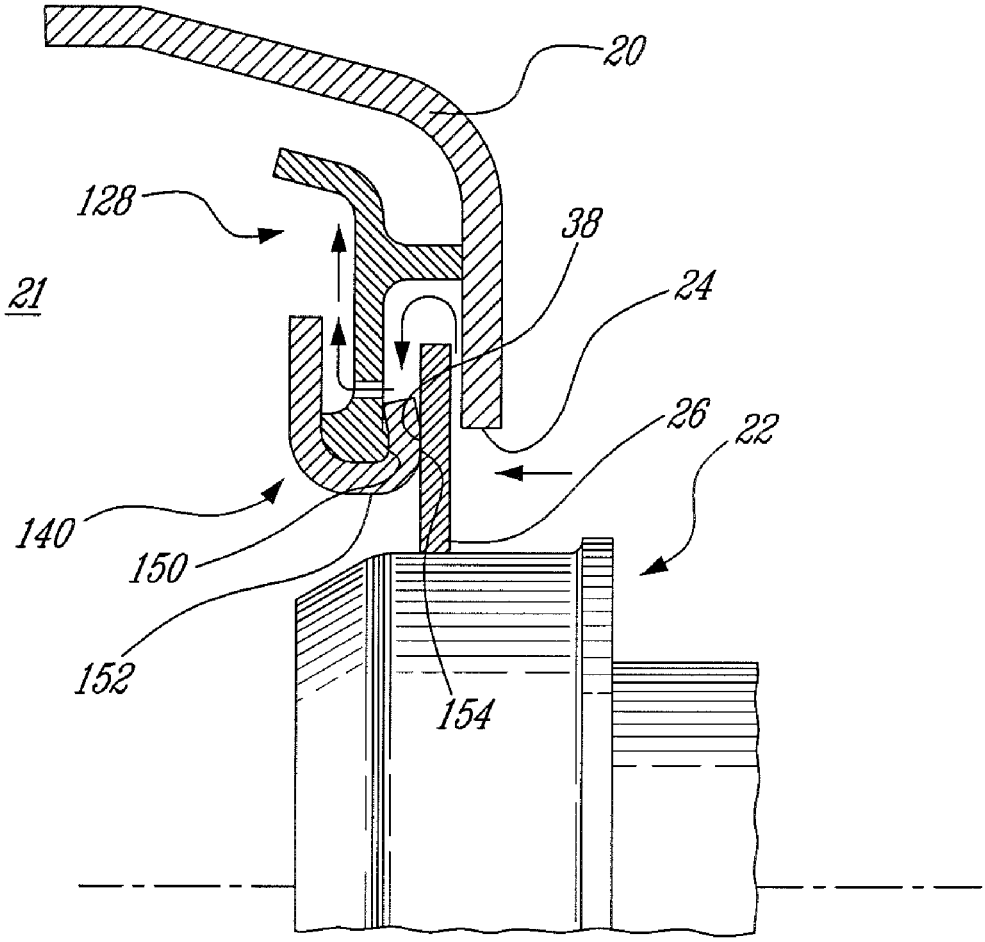
FIGS. 3 to 7 are enlarged views showing alternative louver attachments.

FIG. 3 shows another way of configuring the flaring or bending for attaching the louver 140 to the heat shield 128. The bending of the louver 140 is done around a cast undercut 150 defined on the cold side of the heat shield 128 in place of slots 43. The louver 140 is flared or bent at 152 all along an inner diameter thereof and tucked into the undercut 150 so as to prevent axial withdrawal of the louver 140 from the heat shield 128. The louver 140 is deformed such as to provide a flat sealing surface 154 adapted for sealing engagement with the flat sealing surface 38 of the floating collar 26. The undercut 150 is configured to provide for the formation of the flat surface 154 during flaring. An added benefit of the undercut 150 is that the sheet metal louver spring back is contained in the undercut space, and does not impair the resulting sheet metal flatness.

Figure 4:
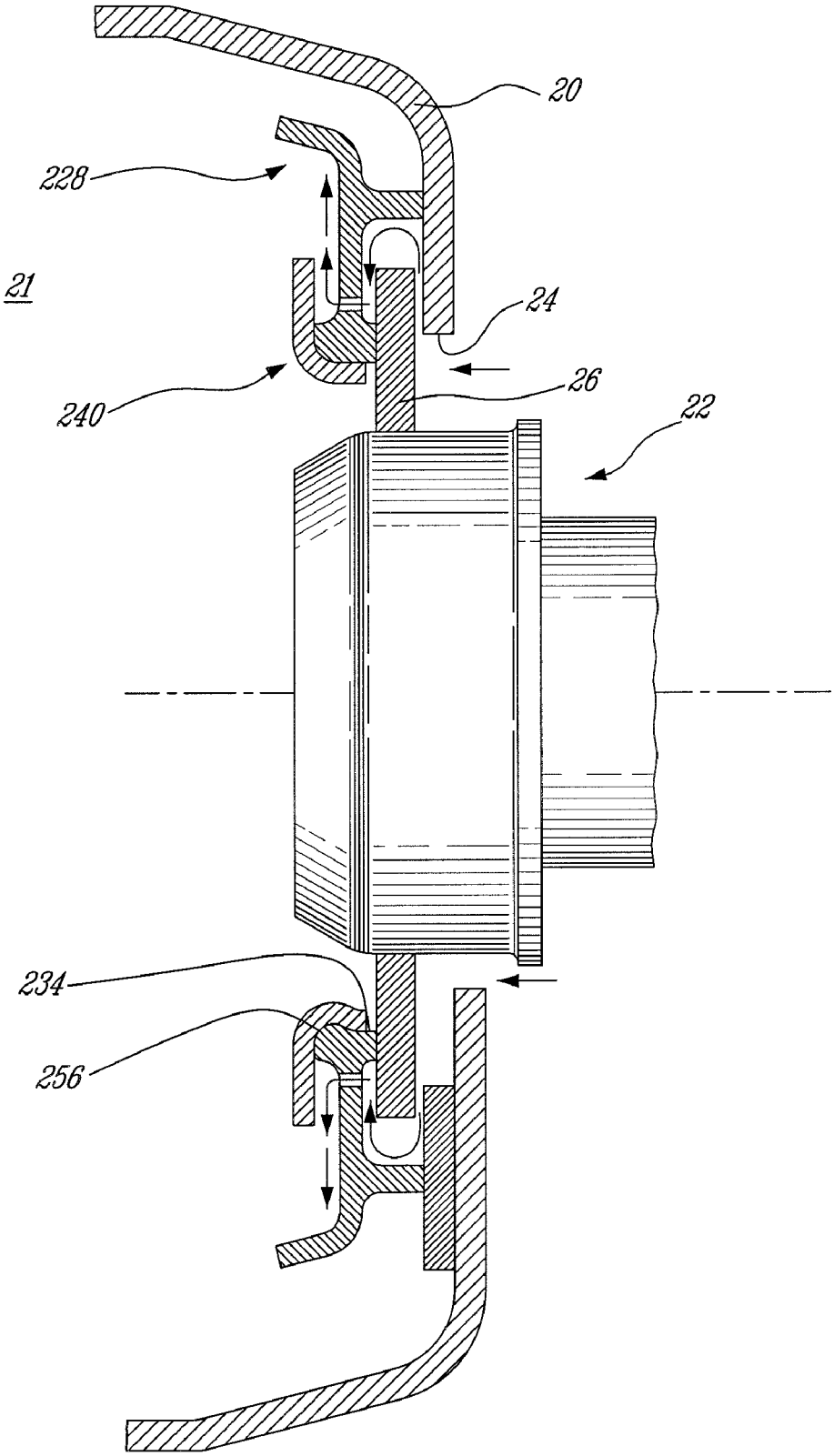

FIG. 4 shows another way of attaching a louver 240 to a heat shield 228. The heat shield 240 is provided along a portion of the circumference of the central opening 234 with a radially inwardly projecting hump 256. The louver 240 is bent over the hump 256 to prevent axial withdrawal of the louver 240 from the heat shield 228.

Figure 5:
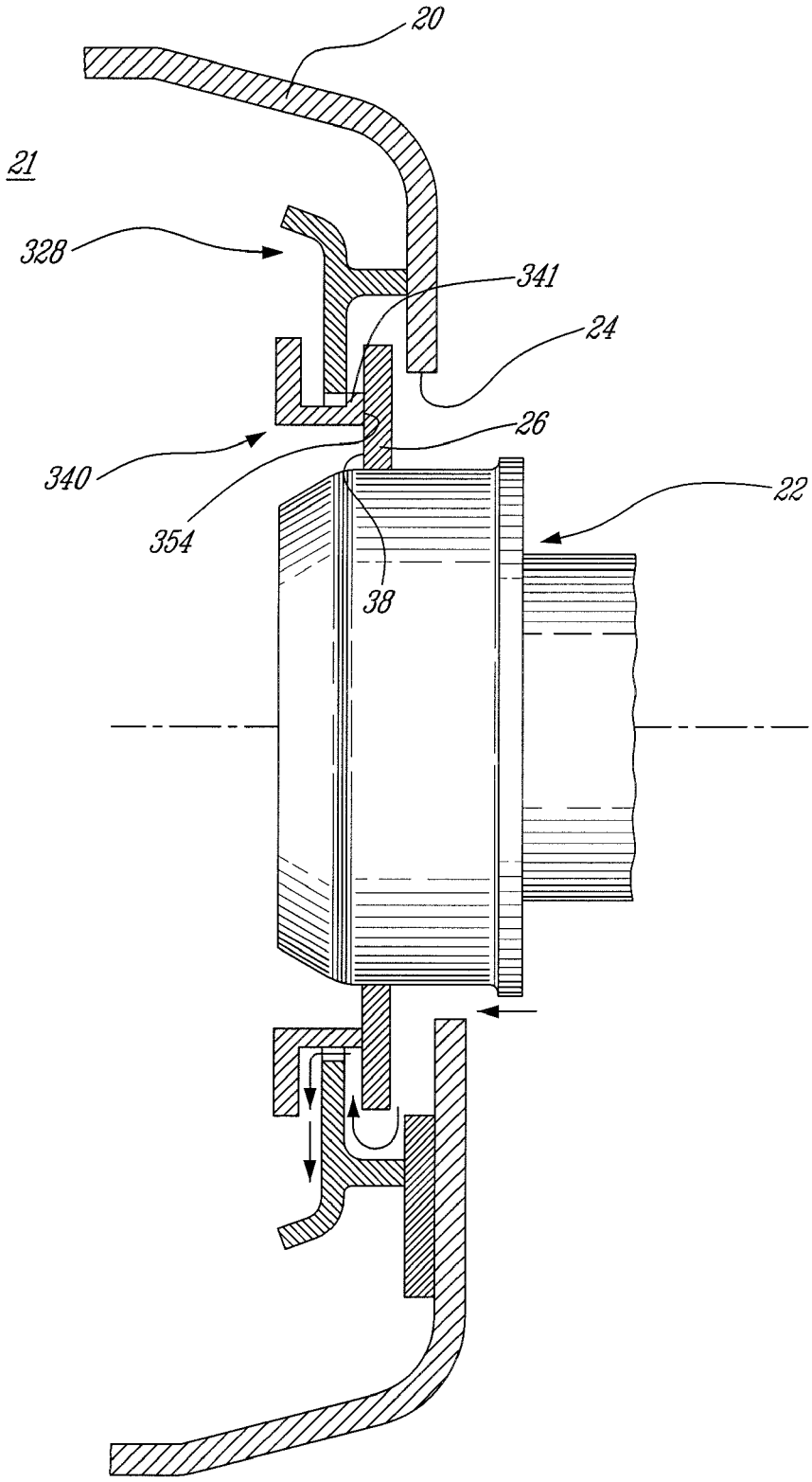

FIG. 5 shows a further way of mounting a louver 340 to a heat shield 328. The louver 340 is provided with a series of circumferentially spaced-apart retention tabs 341 adapted to be bent radially outward behind the upstream or cold surface of the heat shield 328. The louver 340 has a flat end 354 for sealing engagement with the front sealing surface of the floating collar 26.

Figure 6:
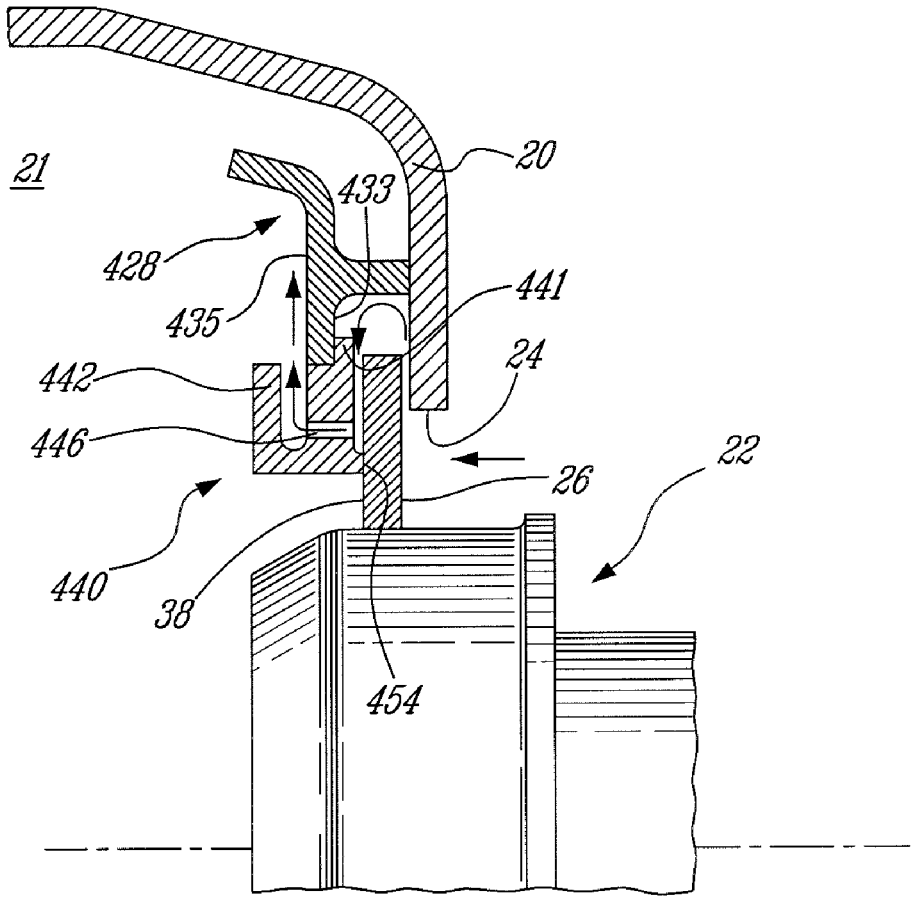

FIG. 6 shows a still further way of attaching a louver 440 to a heat shield 428. The louver 440 has a flow diverting portion 442 which fits into the central opening of the heat shield (i.e. which does not extend over the hot surface 435 of the heat shield 428), thereby allowing the louver 440 to be axially inserted into the central opening of the heat shield 428 in the left hand direction in FIG. 6 and that prior to the heat shield 428 being mounted to the combustor shell 20. The louver 440 is provided with a continuous circumferentially extending flange 441 for engagement with the cold surface 433 of the heat shield 428, thereby preventing axial withdrawal of the louver 440 from the heat shield 428. Cooling holes 446 are defined directly in the louver 440 instead of in the heat shield 428 for allowing cooling air to be fed to the hot side of the heat shield 428. The louver 440 has a flat annular ridge 454 for sealing engagement with the front sealing surface 38 of the floating collar 26.

Figure 7:
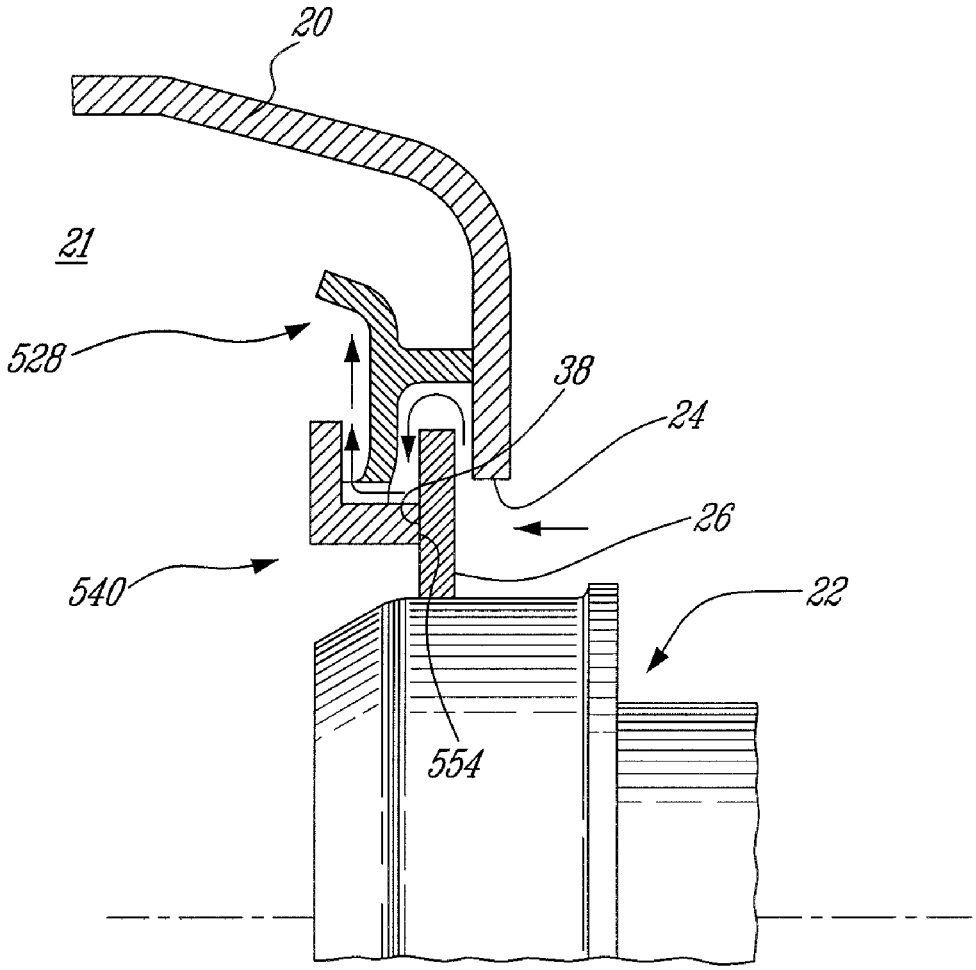

FIG. 7 shows a still further way of mounting a louver 540 to a heat shield 528. The louver 540 and the heat shield 528 are welded together at their interface. The louver 540 has a flat end 554 for sealing engagement with the front sealing surface 38 of the collar 26.

The above description is meant to be exemplary only, and one skilled in the art will recognize that changes may be made to the embodiments described without department from the scope of the invention disclosed. For example, the invention may be provided in any suitable heat shield configuration and in any suitable combustor configuration, and is not limited to application in turbofan engines. Still other modifications which fall within the scope of the present invention will be apparent to those skilled in the art, in light of a review of this disclosure, and such modifications are intended to fall within the appended claims.

What is claimed is:

1. A gas turbine engine combustor comprising a shell enclosing a combustion chamber, a heat shield mounted inside the combustion chamber and spaced-apart from the shell to define an air gap between the heat shield and the shell, the heat shield and the shell each having at least one opening defined therein and cooperating to respectively receive a fuel nozzle, a cooling louver positioned in the opening of the heat shield and having a flow diverting portion extending radially outwardly from the opening of the heat shield on a hot side thereof, the flow diverting portion directing cooling air from said air gap along the hot side of the heat shield, wherein said cooling louver has an upstream end portion removably attached to the heat shield by bendable tabs bent radially outward behind a cool side of said heat shield opposite said hot side thereof.

2. A gas turbine engine combustor as defined in claim 1, wherein said flow diverting portion overlaps said hot side of said heat shield.

3. A gas turbine engine combustor as defined in claim 2, wherein said flow diverting portion is substantially parallel to said hot side of said heat shield.

4. A gas turbine engine combustor as defined in claim 2, wherein said flow diverting portion and said hot side of said heat shield define a plenum therebetween.

5. A gas turbine engine combustor as defined in claim 4, wherein said plenum is connected in fluid flow communication with said air gap via at least one cooling hole defined in one of said cooling louver and said heat shield.

6. A gas turbine engine combustor as defined in claim 1, wherein a collar is mounted to the fuel nozzle in the combustion chamber, and wherein one of said cooling louver and said heat shield is in sealing engagement with said collar.

7. A gas turbine engine combustor, comprising a shell enclosing a combustion chamber, a heat shield member mounted inside the combustion chamber and defining at least one opening for receiving a fuel nozzle, a louver at least partly received in said opening, said louver having a flow diverting portion extending radially outwardly of said opening on a hot side of said heat shield member, and at least one cooling hole for allowing cooling air to flow from a cold side of the heat shield member to the hot side thereof, said at least one cooling hole having an axis intersecting said flow diverting portion of said louver, wherein the louver has a plurality of tabs that are bent into slots defined in the heat shield member.

8. The combustor defined in claim 7, wherein said cooling louver is a sheet metal component, wherein said heat shield member is a cast component, and wherein said sheet metal component is mounted to said cast component.

9. The combustor defined in claim 7, wherein said louver is mounted to said heat shield member with said flow diverting portion substantially parallel to the hot side of the heat shield member, and wherein said cooling hole is defined in one of said heat shield member and said louver.

10. The combustor defined in claim 9, wherein said flow diverting portion overlaps said hot side of said heat shield member.

11. The combustor defined in claim 10, wherein one of said louver and said heat shield member has a flat sealing surface for engagement with a collar mounted to the fuel nozzle.

* * * * *